United States Patent [19]

Bardasz

[11] Patent Number: 5,066,461

[45] Date of Patent: Nov. 19, 1991

[54] TERPINENE-MALEIC ANHYDRIDE ADDUCT DERIVATIVES AS CORROSION INHIBITORS

[75] Inventor: Ewa A. Bardasz, Mentor, Ohio

[73] Assignee: Union Camp Corporation, Wayne, N.J.

[21] Appl. No.: 559,472

[22] Filed: Jul. 30, 1990

[51] Int. Cl.[5] ..... C23F 11/10

[52] U.S. Cl. ..... 422/16; 252/8.555; 252/392; 252/394; 252/396; 252/403; 252/405; 252/407; 422/7; 422/12; 422/14

[58] Field of Search ..... 422/7, 12, 14, 16; 252/8.555, 392, 394, 396, 403, 405, 407

[56] References Cited

U.S. PATENT DOCUMENTS

| | | | |
|---|---|---|---|
| 4,396,492 | 8/1983 | Bardasz | 252/396 |
| 4,946,626 | 8/1990 | Veazey et al. | 252/396 |
| 4,994,575 | 2/1991 | Bardasz | 422/16 |

*Primary Examiner*—Robert J. Warden
*Assistant Examiner*—Timothy M. McMahon
*Attorney, Agent, or Firm*—Edward J. Sites

[57] ABSTRACT

Compounds of the formula:

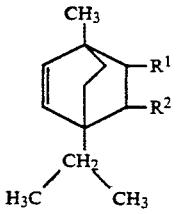

(I)

wherein $R^1$ and $R^2$ when taken independently, each represent the monovalent group of formula:

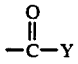

(II)

wherein Y is a monovalent group selected from hydroxyl and a group of the formula:

$$\text{+NH—alkylene}\text{+}_n\text{X} \quad \text{(III)}$$

wherein n is a whole number integer of 0 to 6; X is selected from the group consisting of hydroxyl and amino when n is from 1 to 6; and when n is 0, X is selected from monovalent groups of the formula:

$$\text{—O—alkylene—NR}^3\text{R}^4 \quad \text{(IV)}$$

wherein n has the meaning previously ascribed to it; $R^3$ is selected from the group consisting of hydrogen and $R^4$; and $R^4$ represents a monovalent group of the formula $$\text{—Alkylene—OH;} \quad \text{(V)}$$

provided that $R^1$ and $R^2$ are not both a carboxyl group; and $R^1$ and $R^2$ when taken together represent the divalent moiety of formula:

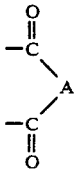

(VI)

wherein A represents one of oxygen and $$\text{N+Alkylene—NH+}_n\text{Alkylene—NH}_2 \quad \text{(VII)}$$

wherein n has the meaning previously ascribed to it; and applied to oxidation prone metals to inhibit corrosion.

10 Claims, No Drawings

TERPINENE-MALEIC ANHYDRIDE ADDUCT DERIVATIVES AS CORROSION INHIBITORS

BACKGROUND OF THE INVENTION

1. Field of the Invention

The invention relates to compounds, compositions and methods for inhibiting corrosion of metals and more particularly to oil-based corrosion inhibitor compositions and their use in inhibiting metal corrosion.

2. Brief Description of the Prior Art

The prior art literature is replete with descriptions of a wide variety of methods and compositions for inhibiting the corrosion of metals, particularly ferrous metals. One U.S. patent which is representative of the prior art descriptions is the U.S. Pat. No. 4,473,491 (Trautmann, et al., Sept. 25, 1984) which describes a class of alkanolamine salts of cyclic amide acids as corrosion inhibitors. An earlier U.S. patent is U.S. Pat. No. 3,095,286 issued June 25, 1963 to Andress, Jr. et al. This patent describes the anti-rusting effect of a nadamic acid (derivative of nadic anhydride) when used as an additive in petroleum distillate fuels.

The massive bulk of literature on this subject over many years, is itself evidence of the lack of complete satisfaction with methods and compositions heretofore available to the artisan. The lack of full satisfaction is due to a broad variety of factors, such as cost, inefficiency of method, toxicity of compositions, relative ineffectiveness, incompatibility of compositions, and difficulty in handling.

The present invention is of a new class of compounds and compositions found to be effective anti-corrosion agents, compatible with oil based systems. The invention then is an expansion of corrosion inhibitors, useful in particular applications.

SUMMARY OF THE INVENTION

The invention comprises a process for inhibiting corrosion of a metal exposed to oxidative conditions, which comprises; applying to the metal a corrosion inhibiting proportion of a compound selected from those having the formula:

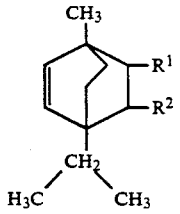

(I)

wherein $R^1$ and $R^2$ when taken independently, each represent the monovalent group of formula:

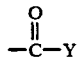

(II)

wherein Y is a monovalent group selected from hydroxyl and a group of the formula:

$$\text{+NH—alkylene+}_n\text{X} \quad \text{(III)}$$

wherein n is a whole number integer of 0 to 6; X is selected from the group consisting of hydroxyl and amino when n is from 1 to 6; and when n is 0, X is selected from monovalent groups of the formula:

$$\text{—O—alkylene—NR}^3\text{R}^4 \quad \text{(IV)}$$

wherein $R^3$ is selected from the group consisting of hydrogen and $R^4$; and $R^4$ represents a monovalent group of the formula:

$$\text{—Alkylene—OH;} \quad \text{(V)}$$

provided that $R^1$ and $R^2$ are not both a carboxyl group; and $R^1$ and $R^2$ when taken together represent the divalent moiety of formula:

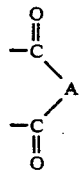

(VI)

wherein A represents one of oxygen and $$\text{N+Alkylene—NH+}_n\text{Alkylene—NH}_2 \quad \text{(VII)}$$

wherein n has the meaning previously ascribed to it.

The invention also comprises anti-corrosion compositions and compounds of the invention, which will be described more fully hereinafter.

The term "Alkylene" as used herein means the divalent moiety obtained upon removal of two hydrogen atoms from a parent hydrocarbon. Representative of alkylene are methylene, ethylene, propylene, butylene, pentylene and hexylene, including isomeric forms thereof.

DETAILED DESCRIPTION OF THE PREFERRED EMBODIMENTS OF THE INVENTION

The corrosion inhibitor compounds employed in the method and compositions of the invention include acid anhydride adducts of alpha-terpinene. The adducts (I) wherein $R^1$ and $R^2$ are taken together and A is oxygen, i.e.; those of the formula:

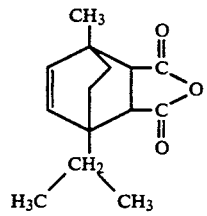

(VIII)

may be prepared by the Diels-Alder reaction or equimolar proportions of maleic anhydride and alpha-terpinene. The Diels-Alder reaction is well known; see for example Martin and Hill (Chem. Revs., 1961, 61, 537); and Huigsen, The Chemistry of Alkenes, S. Patai, Editor, Chapter II, Part V, p. 878. In general, the reaction comprises the thermal or catalyzed addition of maleic anhydride to the conjugated double bonds of alpha-terpinene.

More specifically, the Diels-Alder reaction may be carried out by first charging the reactants to a suitable reaction vessel. The mixture is stirred and heated to effect Diels-Alder adduction. Adductions in the absence of catalyst may be carried out at temperatures of from about 25° C. to about 200° C., preferably from about 100° C. to about 150° C. under ambient pressures. Catalysts for promoting the Diels-Alder reaction are well known and may be employed in catalytic proportions, i.e.; a proportion of from about 0.001 to about 10 weight percent of the reaction mixture. Representative of catalysts which may be employed are aluminum and zinc compounds. In the presence of such catalysts the reaction temperature is normally from about 0° C. to about 100° C., preferably around room temperature and under ambient (atmospheric) pressures.

The Diels-Alder adduction is preferably carried out in the presence of an inert organic solvent. The term "inert organic solvent" is used herein to mean a solvent for the reactants which does not enter into or adversely affect the desired course of the reaction. Representative of inert organic solvents are toluene and xylene, which can dissolve both of the reactants and which boil at advantageous reaction temperatures. In this case, the adduction is carried out simply by charging the solvent and reactants to the reaction vessel, and then heating to reflux temperature. Maintaining reflux temperature until adduction is complete, typically 1–30 hours depending on the solvent chosen, results in the desired adduct of formula (VIII). The completion of the adduction may be observed by conventional and periodic analysis of the reaction mixture. For example infrared analysis will show the appearance of spectra characteristic of the adduct (VIII).

At the conclusion of the adduction reaction the desired product of formula (VIII) may be separated from the reaction mixture by conventional techniques. For example, unreacted reagents and solvent may be removed by distillation.

A preferred class of corrosion inhibitors used in the process of the invention are derivatives of the above-described adducts of formula (VIII), prepared by the reaction of the adducts of formula (VIII) with an amine. The adduct-amine reaction product is one wherein the oxirane ring of the adduct opens and the amine reactant forms a substituent on at least one of the acyl radicals, i.e.; the ring substituent $R^1$ and/or $R^2$ is formed wherein $R^1$ and $R^2$ are each independent of the other.

This preferred adduct-amine reaction product apparently improves bonding in some way to metal surfaces. Corrosion inhibitors incorporated into petroleum products function by reaction chemically with metal surfaces to form thereon a corrosion-resistant, protective film or coating. This film must adhere tightly to the metal surface, lest it is removed by dispersants or detergents. Exposure of a small area of the underlying metal surface can lead to catastrophic attack by acidic contaminants contained within lubricating oils.

The adduct-amine reaction product corrosion inhibitors used in the process of the invention may be prepared by the reaction of the adducts of formula (VIII) described above with an amine, at a temperature within the range of from about 50° C. to 200° C. for a period of time sufficient to obtain the desired substitution (generally from 2 to 8 hours, depending on the temperature selected). Advantageously, the reaction is conducted under an inert gas atmosphere, such as under a blanket of nitrogen or like inert gas. The presence of an inert organic solvent such as xylene or mixed xylenes will promote the desired reaction.

The amine reactants employed in preparing the adduct-amine product are well-known compounds, as are the methods for their preparation. Representative of such amines are those of the formula:

$$H\left[NH\text{-alkylene}\right]_n X \qquad \text{(IX)}$$

wherein X, n and alkylene have the meanings previously ascribed to them.

Representative of the amines of the formula (IX) are ethylene diamine, hexamethylene diamine, diethylene triamine (DETA), diethyleneaminopropylamine, triethylene tetraamine (TETA), tetraethylene pentamine and the like; alkanolamines such as monoethanolamine, isopropanolamine, triethanolamine and the like are a preferred class of amine (IX). The proportion of amine (IX) employed to prepare the adduct-amine reaction product may vary widely but is preferably from 0.25 to 2.5 moles per mole of adduct (VIII). It will be appreciated by those skilled in the art that a stoichiometric proportion of the reactants (VIII) and (IX) is advantageously used to obtain the desired adduct-amine products. Completion of the reaction between the adduct of formula (VIII) and the amine reactant may be observed by conventional analytical technique.

The adduct (VIII)-amine (IX) reaction products are generally obtained in crude reaction mixtures. The crude reaction mixtures themselves may be used as corrosion inhibitors according to the process of the invention or the adduct-amine may be separated from the reaction mixtures by conventional techniques such as distillation and used in relatively pure forms.

The corrosion inhibiting compositions of the invention are prepared by the simple admixture of a metal corrosion inhibiting proportion of the above-described adducts (VIII) and/or their amine derivatives with an oil carrier such as a petroleum oil or grease. Oils which can be used as carrier oils for the compositions described herein include a wide variety of lubricating oils, such as naphthenic base, paraffin base, and mixed base lubricating oils, other hydrocarbon lubricants, e.g. lubricating oils derived from coal products and the synthetic oils, e.g., alkylene polymers (such as polymers of propylene, butylene and mixtures thereof); also alkylene oxide type polymers, e.g., alkylene oxides, e.g. propylene oxide in the presence of water or alcohols (e.g. ethyl alcohol), carboxylic acid esters (e.g. those which are prepared by esterifying carboxylic acids such as adipic acid, azelaic acid, subaric acid, alkenyl succinic acid, fumaric acid, maleic acid and the like with alcohols (such as butyl alcohol, hexyl alcohol, 2-ethylhexyl alcohol, and pentaerithrytol), liquid esters of acids of phosphorous, alkyl benzenes, polyphenyls (e.g. biphenyls and terphenyls, alkyl biphenyl ethers, polymers of silicon (e.g. tetraethyl silicate, tetraisopropyl silicate, tetra(4-methyl-2-tetraethyl)silicate, hexyl-(4-methyl-2-pentoxy)disiloxane, poly(methyl-2-pentoxy)-disiloxane, poly(methyl)siloxane, poly(methylphenyl)siloxane and the like.

The above base oils may be used individually or in combination thereof, when miscible, and whenever made miscible by the use of solvents.

The corrosion inhibitors described herein may be incorporated in thickened lubricating oil compositions, including lubricating oil compositions thickened to the consistency of greases. Such thickening agents include the metal soaps of fatty acids, such as lithium stearate, lithium 12-hydroxystearate, salts of dibasic acid diamine condensation product. Other thickening agents include polyethylene, the salts of monoamides of terephthalic acids, for example, N-octadecyl-lithium terephthalamate, and the like.

Preferred as the base oil carrier is a mineral oil.

A corrosion inhibiting proportion is defined herein as that proportion which will inhibit oxidation of the metal in the presence of an oxidant such as oxygen. In general, a corrosion inhibiting proportion will comprise from about 0.25 to 5.0 percent by weight of the corrosion inhibiting composition. The precise proportion required is dependent upon the adduct (VIII) or particular amine derivative employed, and can be determined by trial and error testing technique.

The following preparations and examples describe the manner and the process of making and using the invention and set forth the best mode contemplated by the inventor for carrying out the invention, but are not to be construed as limiting.

Preparation 1

A suitable reaction vessel was charged with 4945.0 g (20 moles) of alpha-terpinene and 1780.0 g (18.2 moles) of maleic anhydride. The charge was heated at a temperature of from 80° to 120° C. for one hour, with continual stirring. At the end of this addition, the reaction mixture was heated to reflux (150°-180° C.) until GC analysis showed less than 0.5% of maleic anhydride. The reaction mixture was then stripped of residual reactants under vacuum (20 mm Hg) to obtain the Diels-Alder adduct of the alpha-terpinene and the maleic anhydride, i.e.; a compound of the formula:

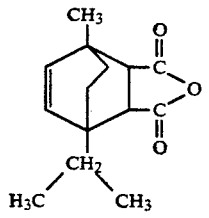

(VIII)

Preparation 2

A suitable reaction vessel was charged with 234.0 g (1.0 mole) of the adduct (VIII) prepared according to the procedure of Preparation 1, supra., and 61.0 g (1.0 mole) of monoethanolamine. The charge was heated to a temperature of 81° to 85° C. for two hours, with stirring. At the end of this time, there was obtained 290.2 g of a mixture of the half acid, monoethanolamine amide of formulae:

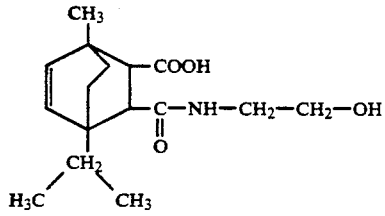

(X)

and

-continued

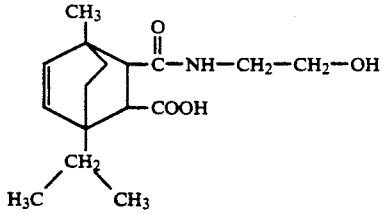

(XI)

The mixture of amides (X) and (XI) is separated from the reaction mixture by distillation.

Preparation 3

A suitable reaction vessel was charged with 234.0 g (1.0 mole) of the adduct prepared according to the procedure of Preparation 1, supra., 61.0 g (1.0 mole) of monoethanolamine and 149.0 g (1.0 mole) of triethanolamine. The charge was heated to a temperature of from 80° to 95° C. for 1.5 hours with stirring. At the end of this time there was obtained 441.5 g of a mixture of compounds of the formulae:

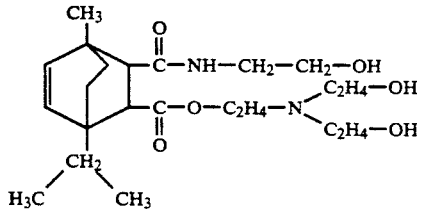

(XII)

and

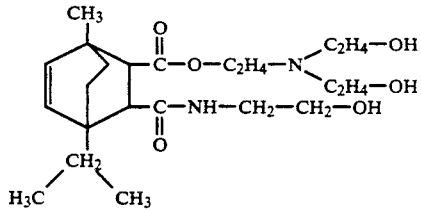

(XIII)

Preparation 4

A suitable reaction vessel is charged with 234.0 g (1.0 mole) of the adduct prepared according to the procedure of Preparation 1, supra, and 49.5 g (0.333 mole) of triethanolamine. The charge was heated to a temperature of 97° to 100° C. for a period of 8.5 hours with stirring to obtain 276.7 g of the ester of formula:

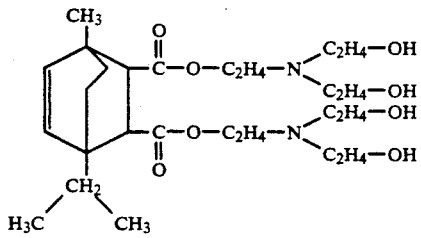

(XIV)

Preparation 5

A suitable reaction vessel was charged with 702.0 g (3.0 moles) of the adduct prepared according to the procedure of Preparation 1, supra., 464.0 g (4.5 moles)

of diethylenetriamine and 87.0 g of xylene. The charge was heated to a temperature of 110°-134° C. with stirring for 4 hours and then to a temperature of 170°-180° C. under a reduced pressure of 250 mm Hg for 0.67 hours, to obtain 918.4 g of the product of formula:

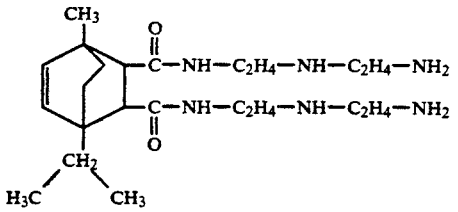

(XV)

Preparation 6

A suitable reaction vessel was charged with 702.0 g (310 moles) of the adduct prepared according to the procedure of Preparation 1, supra., 309.6 g (3.0 moles) of diethylenetriamine and 87.0 g of xylene. The charge was heated with stirring to a temperature of 90°-135° C. for 0.75 hours, then to 135°-167° C. for 3 hours and then to 190° C. under a reduced pressure of 250 mm Hg for 0.5 hours to obtain 847.6 g of the product of formula:

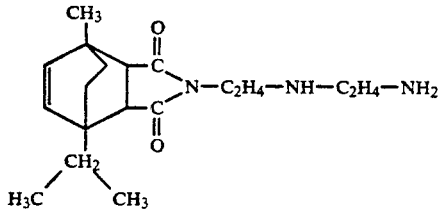

(XVI)

EXAMPLE 1

The compounds of Preparations 1-6, were admixed in various proportions with a light mineral oil (Rudol) having a viscosity within the range of 145-155 SSU at 37.8° C. The oil based compositions were then tested according to the method of ASTM test procedure D-665-A. In this test, a mixture of 300 ml of oil under test is stirred with 30 ml of distilled water at a temperature of 60° C. with a cylindrical steel specimen completely immersed within. After 24 hours immersion, the appearance of the metal surface is rated. In order to report an oil as passing or failing, the test must be conducted in duplicate. An oil is reported as passing the test (P) if both specimens are rust-free at the end of the test period. An oil is reported as failing (F) the test if both specimens are rusted at the end of the test period. If one specimen is rusted while the other is free of rust, tests on two additional specimens are made.

The test results obtained in this example are shown in the following TABLE 1 together with comparisons to test results observed for the mineral oil base carrier alone as a control. The proportions of compound employed are also shown in the TABLE 1 below.

TABLE 1

SUMMARY OF ANTIRUST PERFORMANCE OF TERPENE BASED ADDITIVES

| Weight Percent of Additive | Additive Preparation 1 | 2 | 3 | 4 | 5 | 6 |
|---|---|---|---|---|---|---|
| +0.1% | Failed | NT* | Failed | NT | Failed | Failed |
| +0.25% | Failed | NT | Passed | Failed | Passed | Passed |

TABLE 1-continued

SUMMARY OF ANTIRUST PERFORMANCE OF TERPENE BASED ADDITIVES

| Weight Percent of Additive | Additive Preparation 1 | 2 | 3 | 4 | 5 | 6 |
|---|---|---|---|---|---|---|
| +0.5% | Passed | Failed | Passed | Passed | Passed | Passed |
| +1% | Passed | Passed | NT | Passed | NT | NT |
| Rudol Alone (Control) | Failed | Failed | Failed | Failed | Failed | Failed |

*NT = Not Tested

What is claimed is:

1. A process for inhibiting corrosion of a metal exposed to oxidative conditions, which comprises; applying to the metal a corrosion inhibiting proportion of a compound selected from those having the formula:

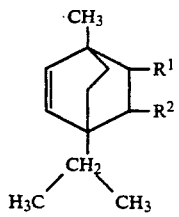

(I)

wherein $R^1$ and $R^2$ when taken independently, each represent the monovalent group of formula:

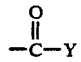

(II)

wherein Y is a monovalent group selected from hydroxyl and a group of the formula:

$$\text{+NH}-C_mH_{2m}\text{+}_n X \quad \text{(III)}$$

wherein m is from 1 to 6; wherein n is a whole number integer of 0 to 6; X is selected from the group consisting of hydroxyl and amino when n is from 1 to 6; and when n is 0, X is selected from monovalent groups of the formula:

$$-O-C_mH_{2m}-NR^3R^4 \quad \text{(IV)}$$

wherein m is from 1 to 6; wherein $R^3$ is selected from the group consisting of hydrogen and $R^4$; and $R^4$ represents a monovalent group of the formula:

$$-C_mH_{2m}-OH; \quad \text{(V)}$$

wherein m is from 1 to 6; provided that $R^1$ and $R^2$ are not both a carboxyl group; and $R^1$ and $R^2$ when taken together represent the divalent moiety of formula:

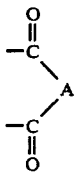

(VI)

wherein A represents one of oxygen and $$N\left(C_mH_{2m}-NH\right)_nC_mH_{2m}-NH_2 \quad \text{(VII)}$$

wherein m is from 1 to 6; wherein n has the meaning previously ascribed to it.

2. The process of claim 1 wherein the compound selected has the formula:

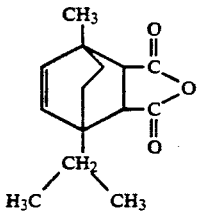

(VIII)

3. The process of claim 1 wherein the compound selected has the formula:

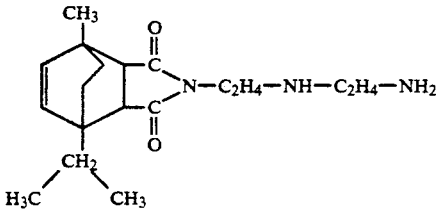

(XVI)

4. The process of claim 1 wherein the compound is selected from the group consisting of:

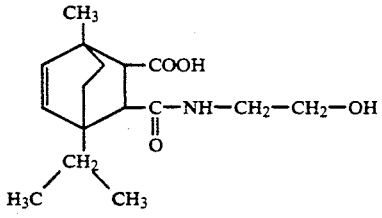

(X)

and

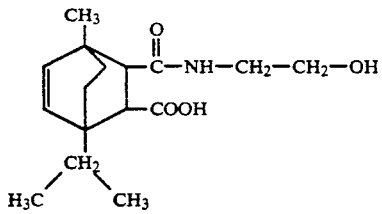

(XI)

5. The process of claim 1 wherein the compound is selected from the group consisting of:

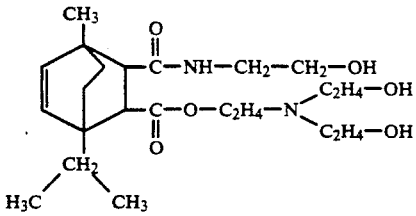

(XII)

and

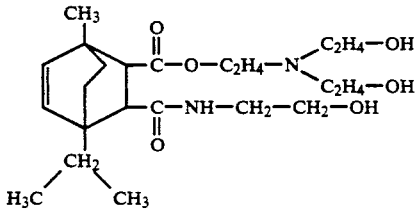

(XIII)

6. The process of claim 1 wherein the compound selected has the formula:

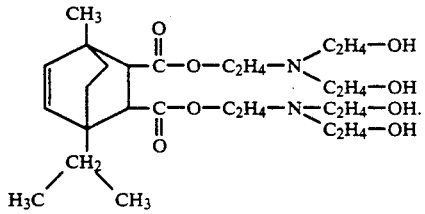

(XIV)

7. The process of claim 1 wherein the compound selected has the formula:

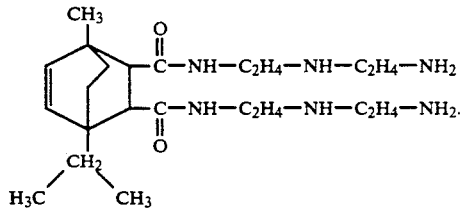

(XV)

8. The process of claim 1 wherein the metal is ferrous.

9. The process of claim 1 wherein the compound selected is in admixture with an oil carrier.

10. The process of claim 9 wherein the oil carrier is a mineral oil.

* * * * *